US005577425A

United States Patent [19]

Holmin et al.

[11] Patent Number: 5,577,425

[45] Date of Patent: Nov. 26, 1996

[54] ANGLE TYPE POWER NUTRUNNER

[75] Inventors: Mats C. Holmin, Stockholm; Bengt G. Wallerius, Saltsjöbaden, both of Sweden

[73] Assignee: Atlas Copco Tools AB, Nacka, Sweden

[21] Appl. No.: 499,434

[22] Filed: Jul. 7, 1995

[30] Foreign Application Priority Data

Jul. 8, 1994 [SE] Sweden ..... 9402416

[51] Int. Cl.[6] ..... B25B 13/46

[52] U.S. Cl. ..... 81/57.39; 81/57.13

[58] Field of Search ..... 81/57.12, 57.13, 81/57.26, 57.28, 57.29, 57.39; 173/178

[56] References Cited

U.S. PATENT DOCUMENTS

| | | | |
|---|---|---|---|
| 4,064,948 | 12/1977 | Bratt et al. | 173/178 |
| 4,458,565 | 7/1984 | Zilly et al. . | |
| 4,627,761 | 12/1986 | Olson et al. . | |
| 4,791,836 | 12/1988 | D'Haem et al. | 81/57.13 X |
| 5,052,496 | 10/1991 | Albert et al. | 81/57.13 X |

FOREIGN PATENT DOCUMENTS

| | | |
|---|---|---|
| 95850129 | 10/1995 | European Pat. Off. . |
| 1519896 | 2/1968 | France . |
| 2462678 | 10/1980 | Germany . |
| 0092736 | 11/1983 | Germany . |
| 0511485 | 11/1992 | Germany . |

*Primary Examiner*—James G. Smith
*Attorney, Agent, or Firm*—Frishauf, Holtz, Goodman, Langer & Chick

[57] ABSTRACT

An angle type power nutrunner having a housing (10) with a rotation motor, an angle head (15) with an output shaft (13), and a thread connection (21) including a lock nut (22) for securing the angle head (15) to the housing (10). The housing (10) is provided with a first group of radial holes (25) disposed in a circumferentially directed row and the angle head (15) is provided with a second group of radial holes (26) disposed in a circumferentially directed row, and a key pin is arranged to positively define alternative angular positions between the angle head (15) and the housing (10) by engaging selectively one hole each of the first and second groups of holes. The pitch of the first group of holes (25) is different than the pitch of the second group of holes (26) for enabling a small angle adjustment of the angle head (15) in relation to the housing (10).

20 Claims, 1 Drawing Sheet

ANGLE TYPE POWER NUTRUNNER

BACKGROUND OF THE INVENTION

This invention concerns an angle type power nutrunner having a housing with a rotation motor, an angle head with an output shaft, and a thread connection for securing the angle head to the housing and including mating threads on the angle head and the housing and a lock nut.

Power nutrunners of this type are previously well known and may be exemplified by U.S. Pat. No. 4,064,948. The angle nutrunner disclosed in this patent lacks however a lock nut, which means that there is no provision made for angular adjustability of the angle head in relation to the tool housing. In later modifications of this nutrunner, the thread connection between the angle head and the housing does comprise a lock nut to enable setting and securing of the angle head in desired angular positions. Such an adjustability of the angle head is important for the operator to obtain a comfortable working posture.

This prior art nutrunner has a drawback in that it is difficult to have its angle head secured in a desired angular position during assembly of the tool. In other words, it is difficult to maintain the angle head in a correct desired angular position when tightening the lock nut.

Another drawback of this known angle nutrunner is that the lock nut arrangement for rotational locking of the angle head to the housing relies on friction forces only. This has been considered unsatisfactory from the safety point of view, because the frictional locking accomplished by the lock nut may not always withstand the reaction torque transferred between the angle head and the housing. This could result in an undesireable movement between the angle head and the housing during operation of the tool, which would be hazardeous to the operator.

In another prior art angle nutrunner, disclosed in U.S. Pat. No. 4,458,565, the angle head is axially clamped to the tool housing by means of a threaded sleeve, whereas axially directed teeth on the angle head engage a lock pin on the tool housing to positively lock the angle head against rotation.

Alternative angular positions of the angle head are obtained by loosening the threaded sleeve and moving the angle head into a new position where another one of the teeth engages the lock pin, and then retightening the sleeve.

Still another interesting piece of prior art refers to certain types of pneumatic chisel hammers wherein a thread connection between the cylinder of the impact mechanism and the tool handle comprises a lock pin which engages simultaneously one hole of a circumferential row of holes in the handle and one hole of a circumferential row of holes in the cylinder, wherein the pitch of the holes in the handle is different from the pitch of the holes in the cylinder.

Although, this previously known locking means has a certain resemblance with the present invention, it is important to notice that this known device is a pure thread locking device intended to be engaged after the thread connection has been firmly tightened and to maintain the thread connection in that firmly tightened state. This is very much the same thing as a cotter pin locking of a slotted nut and is not intended to define any other angular positions between the threaded parts than the fully tightened position.

SUMMARY OF THE INVENTION

The main object of the invention is to accomplish an improved angle type power nutrunner having a thread connection between the angle head and the housing and including a positively acting position defining locking means.

Another object of the invention is to accomplish an angle nutrunner with a positively acting angle head locking means which enables a small angle adjustment of the angle head relative to the housing.

The above objects are attained by using a thread connection between the angle head and the housing which includes a lock nut for securing the angle head in alternative angular positions relative to the housing and a radial key pin for defining positively such alternative angular positions by engaging simultaneously one of the holes of a first group of radial holes in either one of the angle head and the housing and one of the holes of a second group of radial holes in the other one of the angle head and the housing. The holes of the first group of holes are circumferentially distributed at a certain pitch and the holes of the second group of holes are distributed at a pitch different from the pitch of the first group of holes.

Further objects and advantages of the invention appear from the following specification and claims.

A preferred embodiment of the invention is hereinbelow described in detail with reference to the accompanying drawing.

DETAILED DESCRIPTION

Figure 1:
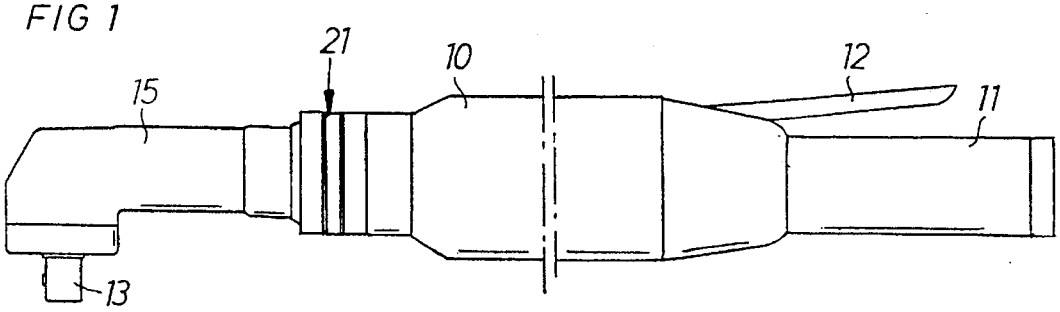
FIG. 1 shows a side view of an angle type power nutrunner according to the invention.
Figure 2:
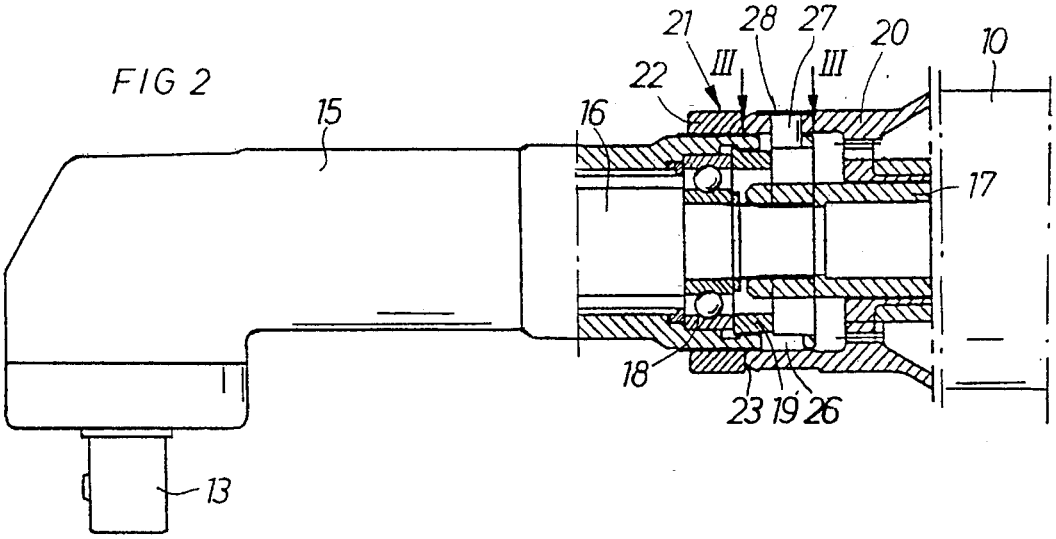
FIG. 2 shows, on a larger scale and partly in section, a side view of the forward part of the nutrunner.

The angle nutrunner shown in the drawing figures may be preumatically or electrically powered and contain any type of torque control means.

As being illustrated in FIG. 1, the nutrunner comprises a cylindrical housing 10 provided with a rear handle 11. On the handle 11 there is supported a lever 12 by which a power control means (not shown) is activated. Within the housing 10 there is supported a rotation motor which via a power transmission is coupled to an output shaft 13. The latter is journalled in an angle head 15 and is formed with a square end for receiving a standard type nut socket.

The angle head 15 contains a bevelled gear (not shown) which via a drive spindle 16 is coupled to a transmission shaft 17 in the housing 10. The rear end of the drive spindle 16 is journalled in a ball bearing 18 which is secured in the angle head 15 by a threaded ring 19.

The rear end of the angle head 15 is formed with an outer thread for engagement with an inner thread cut in a neck portion 20 of the housing 10, thereby forming a thread connection 21 between the angle head 15 and the housing 10. This thread connection 21 also includes a lock nut 22 for firmly securing the angle head 15 to the housing 10 when tightened against the front end surface 23 of the neck portion 20.

With the purpose to positively define alternative angular positions of the angle head 15 in relation to the housing 10, there are provided a first group of radial holes 25 in the housing neck portion 20 and a second group of radial holes 26 in the angle head 15. The holes of both the first group and second group are disposed in circumferentially directed rows and are arranged to be selectively engaged by a key pin 27 to define alternative angular positions of the angle head 15. A ring element in the form of a band 28 of a spring material is applied on the outside of the housing neck portion 20 to prevent the key pin 27 from falling out. The band 28 encompasses about ¾ of the peripheri and is rotatably supported.

Figure 4:
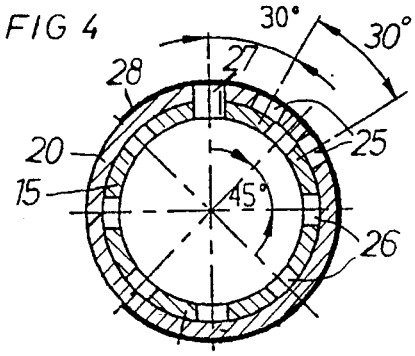
FIG. 4 shows a cross section along line IV—IV in FIG. 2.

As being illustrated in FIG. 4, the first group of holes 25 are three in number and spaced at a constant pitch of 30°. The holes 26 of the second group are eight in number and circumferentially distributed at a constant pitch of 45°. Accordingly, the pitch of the first group of hole 25 is ⅔ of the pitch of the second group of holes 26.

These hole patterns make it possible to obtain positively defined angular positions of the angle head 15 at 15° intervals all the way round the peripheri. This makes it possible for the operator to find a position for the angle head 15, which in relation to the power control lever 12 on the tool handle 11 gives a comfortable and safe working posture.

Figure 3:
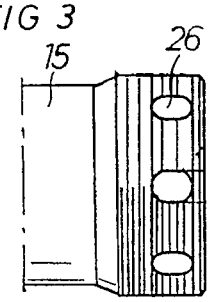
FIG. 3 shows a side view of the rear end of the angle head.

In FIG. 3 there is illustrated that the holes 26 of the second group of holes are noncircular in cross section. Instead, they have a larger extent in the axial direction of the thread connection 21 so as to compensate for the inevitable axial displacement when turning the angle head 15.

When fitting the angle head 15 to the housing 10, the rear end of the angle head 15 is threaded into the housing neck portion 20 to a level where the first and second groups of holes 25, 26 are substantially in the same transverse plane. The angle head 15 is turned into a desired angular position, and the key pin 27 is introduced through that one of the three holes 25 in the first group of holes that coincides with one of the holes 26 in the second group of holes in the angle head 15. The cover band 28 is rotated to a position where it covers the key pin 27 and retains the latter in locking position. Now, the desired angular position of the angle head 15 is positively defined.

To finally secure the angle head 15 firmly to the housing 10 the lock nut 22 is tightened against the front end surface 23 of the housing neck portion 20. Owing to the positive interlocking between the angle head 15 and the housing 10, tightening of the lock nut 22 will not cause any undesireable displacement of the angle head 15. The assembly of the nutrunner is thereby fascilitated.

It is to be understood that the above described angle nutrunner is just an example and that the embodiments of the invention are not limited thereto. For example, the first and second groups of holes 25, 26 could be arranged in other patterns with other pitches and other number of holes. The pitches do not neccesarily have to be constant.

We claim:

1. An angle type power nutrunner, comprising:

a cylindrical housing (10) with a rotation motor, and an angle head (15) in which is journalized an output shaft (13), said angle head (15) being adjustably secured to said housing (10) in alternative angular positions by means of a thread connection (21) including mating threads on said angle head (15) and said housing (10), and a lock nut (22), wherein:

either one of said housing (10) and said angle head (15) is provided with a first group of radial holes (25) disposed in a circumferentially directed row, the other one of said housing (10) and said angle head (15) is provided with a second group of radial holes (26) disposed in a circumferentially directed row, and a radially extending key pin (27) is arranged to engage simultaneously one hole each of said first group of holes (25) and said second group of holes (26) to thereby positively define one of said alternative angular positions between said angle head (15) and said housing (10).

2. Nutrunner according to claim 1, wherein:

said holes (25) of said first group of holes are disposed at a constant pitch, and said holes (26) of said second group of holes are disposed at a constant pitch, and said pitch of said first group of holes (25) differs from said pitch of said second group of holes (26) and any multiple thereof as well as from half of the pitch of said second group (26) of holes and any multiple thereof.

3. Nutrunner according to claim 2, wherein said pitch of said first group of holes (25) is ⅔ of said pitch of said second group of holes (26).

4. Nutrunner according to claim 1, wherein said first group of holes (25) is located on said housing (10), and said second group of holes (26) is located on said angle head (15).

5. Nutrunner according claim 1, wherein said key pin (27) is retained in its locking position by a ring element (28) supported on an outside portion of said housing (10).

6. Nutrunner according to claim 1, wherein each hole of at least one of said first and second groups of holes (25, 26) has a width in an axial direction of said thread connection (21) that exceeds a corresponding dimension of said key pin (27).

7. Nutrunner according to claim 1, wherein:

the holes (25) of said first group of holes are three in number and are angularly spaced from each other by 30°, and the holes (26) of said second group of holes are eight in number and are angularly spaced from each other by 45°.

8. Nutrunner according to claim 3, wherein said first group of holes (25) is located on said housing (10), and said second group of holes (26) is located on said angle head (15).

9. Nutrunner according to claim 2, wherein said key pin (27) is retained in its locking position by a ring element (28) supported on an outside portion of said housing (10).

10. Nutrunner according to claim 3, wherein said key pin (27) is retained in its locking position by a ring element (28) supported on an outside portion of said housing (10).

11. Nutrunner according to claim 4, wherein said key pin (27) is retained in its locking position by a ring element (28) supported on an outside portion of said housing (10).

12. Nutrunner according to claim 8, wherein said key pin (27) is retained in its locking position by a ring element (28) supported on an outside portion of said housing (10).

13. Nutrunner according to claim 2, wherein each hole of at least one of said first and second groups of holes (25, 26) has a width in an axial direction of said thread connection (21) that exceeds a corresponding dimension of said key pin (27).

14. Nutrunner according to claim 3, wherein each hole of at least one of said first and second groups of holes (25, 26) has a width in an axial direction of said thread connection (21) that exceeds a corresponding dimension of said key pin (27).

15. Nutrunner according to claim 4, wherein each hole of at least one of said first and second groups of holes (25, 26) has a width in an axial direction of said thread connection (21) that exceeds a corresponding dimension of said key pin (27).

16. Nutrunner according to claim 8, wherein each hole of at least one of said first and second groups of holes (25, 26) has a width in an axial direction of said thread connection (21) that exceeds a corresponding dimension of said key pin (27).

17. Nutrunner according to claim 2, wherein:

the holes (25) of said first group of holes are three in number and are angularly spaced from each other by 30°, and the holes (26) of said second group of holes are eight in number and are angularly spaced from each other by 45°.

18. Nutrunner according to claim 3, wherein:

the holes (25) of said first group of holes are three in number and are angularly spaced from each other by 30°, and the holes (26) of said second group of holes are eight in number and are angularly spaced from each other by 45°.

19. Nutrunner according to claim 4, wherein:

the holes (25) of said first group of holes are three in number and are angularly spaced from each other by 30°, and the holes (26) of said second group of holes are eight in number and are angularly spaced from each other by 45°.

20. Nutrunner according to claim 8, wherein:

the holes (25) of said group of holes are three in number and are angularly spaced from each other by 30°, and the holes (26) of said second group of holes are eight in number and are angularly spaced from each other by 45°.

* * * * *